United States Patent [19]

Chiang

[11] Patent Number: 4,753,718

[45] Date of Patent: Jun. 28, 1988

[54] HYDROGEN PEROXIDE ELECTROLYTIC CELL

[75] Inventor: John S. C. Chiang, Mercerville, N.J.

[73] Assignee: FMC Corporation, Philadelphia, Pa.

[21] Appl. No.: 932,836

[22] Filed: Nov. 20, 1986

[51] Int. Cl.[4] ..... C25B 9/00; C25B 11/03; C25B 11/12

[52] U.S. Cl. ..... 204/265; 204/266; 204/294; 204/283; 204/284

[58] Field of Search ..... 204/256, 258, 265, 266, 204/294, 283–284

[56] References Cited

U.S. PATENT DOCUMENTS

| | | | |
|---|---|---|---|
| 3,379,626 | 4/1968 | Heuse et al. | 204/266 X |
| 3,454,477 | 7/1969 | Grangaard | 204/84 |
| 3,459,652 | 8/1969 | Grangaard | 204/294 |
| 3,462,351 | 8/1969 | Grangaard | 204/83 |
| 3,506,560 | 4/1970 | Grangaard | 204/263 |
| 3,507,769 | 4/1970 | Grangaard | 204/265 |
| 3,591,470 | 7/1971 | Grangaard | 204/84 |
| 3,592,749 | 7/1971 | Grangaard | 204/84 |
| 3,968,273 | 7/1976 | Kastening et al. | 204/265 X |
| 3,969,201 | 7/1976 | Oloman et al. | 204/83 |
| 4,118,305 | 10/1978 | Oloman et al. | 204/265 |
| 4,344,832 | 8/1982 | Dahlberg | 204/258 |
| 4,406,758 | 9/1983 | McIntyre et al. | 204/98 |
| 4,430,176 | 2/1984 | Davison | 204/84 |
| 4,431,494 | 2/1984 | McIntyre et al. | 204/83 |
| 4,445,986 | 5/1984 | McIntyre et al. | 204/265 X |
| 4,457,953 | 7/1984 | McIntyre et al. | 427/113 |
| 4,481,303 | 11/1984 | McIntyre et al. | 502/159 |
| 4,511,441 | 4/1985 | McIntyre et al. | 204/98 |
| 4,534,845 | 8/1985 | McIntyre et al. | 204/265 X |
| 4,657,651 | 4/1987 | Wainerdi | 204/265 |

OTHER PUBLICATIONS

Haggin, J., "Trickle-Bed Electrolytic Cell for Peroxide Developed", *C&EN*, 3/12/84, p. 16.

Oloman et al., "Hydrogen Peroxide Production in Trickle Bed Electrochemical Reactors, *J. of App. Electrochem.*, 9, 117–123.

*Primary Examiner*—Donald R. Valentine

*Attorney, Agent, or Firm*—Richard E. Elden; Robert L. Andersen; Eugene G. Seems

[57] ABSTRACT

The invention is an electrochemical cell which is useful to reduce oxygen to hydrogen peroxide at a cathode. The cell avoids the safety hazard of a hydrogen explosion of the prior art cells. The cell has an added advantage in that the dimensions of the cathode are not limited by hydrostatic pressures or by the capacity of the channels and pores of the cathode.

6 Claims, 2 Drawing Sheets

HYDROGEN PEROXIDE ELECTROLYTIC CELL

The present invention is an electrochemical cell suitable for safely reducing oxygen to hydrogen peroxide at a cathode in the presence of an alkaline electrolyte.

For over a hundred years it has been known that oxygen can be reduced at a cathode to form hydrogen peroxide. In spite of the very low voltage for the half-cell reaction the process has never been commercialized.

U.S. Pat. Nos. 4,406,758 and 4,511,441 teach a method for operating an electrochemical cell employing a gas cathode. The electrolyte is introduced into the cell in the anode compartment where a gas such as oxygen or chlorine is formed. The electrolyte then passes through a separating means into a "trickle bed" or self-draining cathode. Oxygen gas is also introduced into the cathode and is reduced to form hydrogen peroxide. The hydrogen peroxide can optionally be decomposed or collected and employed as a bleach solution.

Both of these patents teach that the desired electrolytic reaction with gas will take place only where there is a three-phase contact between a gas, an electrolyte solution and a solid electrical conductor. The patents teach that it is necessary to balance the hydraulic pressure of the electrolyte on the anode side of the separating means and on the cathode side of the separating means to maintain a controlled flow of electrolyte into the cathode and to maintain oxygen gas throughout the cathode. Pores of a sufficient size and number are provided in the cathode to allow both gas and liquid to flow simultaneously through the cathode.

The presence of oxygen is required at an oxygen cathode not only to maintain a high efficiency, but also to avoid a disastrous explosion. In the presence of an alkali metal hydroxide the oxygen cathode overall reaction is the reaction of oxygen and water to form hydroxyl ions and perhydroxyl ions (anions of hydrogen peroxide, a very weak acid). The cathode reaction is $$2O_2+2H_2O+4e^-\rightarrow 2HO_2^{31}+2OH^- \quad (1)$$

and the anode reaction is $$4OH^-\rightarrow O_2+2H_2O+4e^- \quad (2)$$

with an overall reaction of $$O_2+2OH^-\rightarrow 2HO_2^-. \quad (3)$$

In the absence of oxygen at the cathode that half cell reaction is $$2H_2O+4e^-\rightarrow H_2+2OH^-. \quad (4)$$

Undesirable side reactions can also take place at the cathode $$HO_2^-+H_2O+2e^-\rightarrow 3OH^- \quad (5)$$

and at the anode $$HO_2^-+OH^-\rightarrow O_2+H_2O+2e^- \quad (6)$$

Consequently, it is important to avoid a local high concentration of the perhydroxyl ion ($HO_2^-$) from accumulating in the catholyte.

Equation (4) can predominate if the cathode does not contain oxygen gas or hydrogen peroxide (equation 5) either because the cell is flooded with electrolyte, or because the supply of oxygen is inadequate. In the absence of oxygen at the cathode hydrogen gas will be formed. The hydrogen gas may form an explosive mixture with oxygen gas in the oxygen supply manifold. In the alternative, if insufficient oxygen were introduced into the cathode, hydrogen would be formed in the oxygen-depleted section which would mix with oxygen in the oxygen-rich zone to form an explosive mixture.

In U.S. Pat. Nos. 3,454,477; 3,459,652; 3,462,351; 3,506,560; 3,507,769; 3,591,470, and 3,592,749 to Grangaard, the cathode is a porous plate with the electrolyte and oxygen delivered from opposite sides for reaction on the cathode. The porous gas diffusion electrode requires a wax coating to fix the reaction zone and careful balancing of oxygen and electrolyte pressure to keep the reaction zone near the surface of the porous plate.

The electrolytic cells of U.S. Pat. Nos. 4,406,758 and 4,511,441 have a problem in that vertical dimension of the cell cannot be varied over a large range because of the need to balance the hydraulic pressure differences across the separating means and the need to avoid flooding the cathode with electrolyte, an uncontrolled flow of liquid through the separator is considered to be undesirable.

The present invention is an electrolytic cell for reducing oxygen to hydrogen peroxide at a cathode in the presence of an aqueous alkaline electrolyte comprising a cell having an electrolyte inlet, a porous, self-draining cathode with a first surface contacting electrolyte and a second surface forming an exterior surface of the cell, an electrolyte outlet disposed to receive electrolyte draining from the cathode, an anode, separating means between the cathode and the anode. The separating means is substantially permeable to the electrolyte and defines an anode compartment containing the electrolyte inlet and a cathode compartment. The second surface of the cathode is in contact with an oxygen-containing gas, and means are provided to controllably urge the electrolyte from the electrolyte inlet through the separating means and into the self-draining cathode at a rate about equal to the drainage rate of the electrolyte from the cathode and in a quantity sufficient to fill only a portion of the pores of the cathode and having means to exhaust a gas in the anode compartment out of the electrolytic cell.

When the electrolytic cell is disposed so that the cathode is generally vertical it is desirable for the cell to contain means to divert oxygen gas generated at the anode in the anode compartment electrolyte away from the separating means to prevent increasing the ohmic resistance of the cell.

In a particularly desirable embodiment of the present invention, the cell is disposed so that the cathode is maintained in a generally horizontal position. If the anode is disposed in the cell in a position superior to the cathode the anode may desirably provide holes or pores as means to divert the buoyant oxygen gas in the electrolyte in the anode compartment away from the separating means. Desirable means to divert oxygen gas can include not only louvres in the anode, but also channels in the anode leading the bubbles up and to either side or both sides, for example, in a "herring bone" pattern. Equally effective are mechanical wipers or "paddle-wheels" which can be driven by the rising bubbles to both sweep the other bubbles from the area and sweep fresh solution into the space between the anode and the separating means.

In another particularly desirable embodiment of the present invention the anode and cathode are disposed in a generally horizontal position at an angle of about 5° to 25°. The cathode is above (superior to) both the anode and separating means, and is composed of granular particles supported by the separating means. The means to urge the electrolyte from the electrolyte inlet and into the self-draining cathode is the static head of the electrolyte inlet above the electrolyte outlet and the wicking effect of the porous separating means.

The cathode is an electrically conductive porous mass having a plurality of pores and channels passing therethrough. It may be a bed of electroconductive particles sintered to form a unitary mass or an agglomeration of loose particles. It must have pores of sufficient size and number to allow gas to flow therethrough. The channels must be of a sufficient size such that nonvolatile products will flow by gravity from the cathode, that is, the cathode should be "self-draining". Another way of expressing this is to describe the channels as being large enough so that gravity has a greater effect on the liquid in the electrode than does capillary pressure.

The means to urge the electrolyte from the electrolyte inlet through the separating means and into the self-draining cathode and to controllably urge the electrolyte through the separating means may be combined by inclining the cell so that the electrolyte inlet is raised above the electrolyte outlet. Alternatively, the electrolyte may be urged by a pump or other means to provide a greater pressure at the electrolyte inlet, and the means to controllably urge the electrolyte through the separating means and into the self-draining cathode may be by uniformly reducing the cross sectional area of the cell from the inlet end to the outlet end of the cell.

Any convenient separating means may be used in the cell. For example, a ceramic diaphragm, an ion selective membrane such as a cation membrane which is also porous to the aqueous electrolyte. Other separating means such as a microporous plastic, a mat of asbestos, woven or felted fibers or a porous plastic may also be suitable. Support may be required as part of the separating means.

The following figures illustrate three of the preferred embodiments of the invention in detail.

Figure 1:
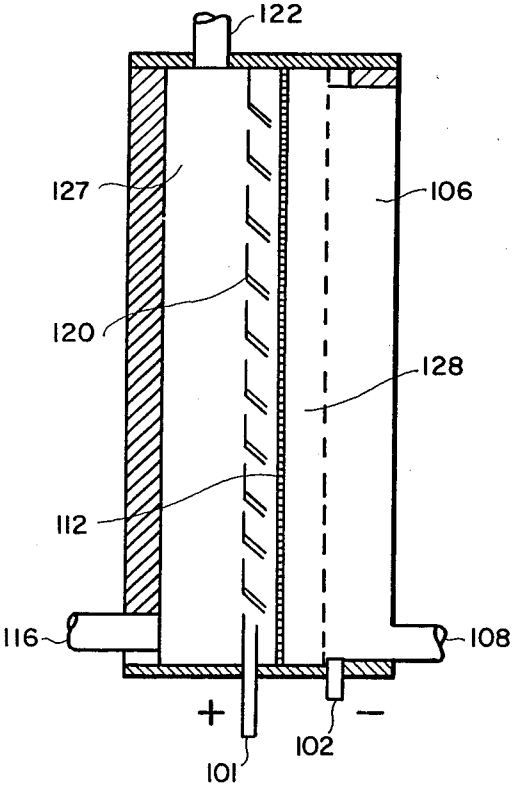
FIG. 1 is a cross sectional view of a cell in which the cathode, separating means and anode are disposed in a generally vertical position.

FIG. 1 illustrates an electrolytic cell. The cell has louvred anode 120 which is located in an anolyte compartment 127. An electrolyte inlet port 116 opens into the anolyte compartment. A gaseous product outlet port 122 is located in the anolyte compartment 127. The first surface of cathode 106 contacts the electrolyte in cathode compartment and the second surface forms an exterior surface of the cell and is in contact with an oxygen containing gas such as air. An electrolyte outlet port 108 collects liquid electrolyte from cathode. Separating means 112 divides the cell into anode compartment and cathode compartment.

The separating means 112 may be a plurality of layers or a single layer. However, the material should be substantially inert to the chemicals that it will contact under ordinary operating conditions. The separating means is constructed so that it has a somewhat limited ability to allow liquid to flow therethrough. Anode 120 is preferably equipped with louvres and is connected by conductor 101 to a positive source of voltage (not shown). Similarly cathode 106 is connected by conductor 102 to a negative source of voltage.

In operation, electrolyte is introduced into the cell through inlet port 116 and is urged through separating means 112 into the cathode compartment and into the cathode 106. The liquid trickles down through the channels of the cathode by gravity and is collected and removed from the cell through electrolyte outlet port 108. An electric potential or voltage is applied between anode 120 and cathode 106; at the anode oxygen gas is formed, and rises as bubbles in the electrolyte between anode 120 and separating means 112. The bubbles are diverted by the louvres to the other side of anode 120, and is then exhausted through port 122. At cathode 106 oxygen which diffuses from the air into the cathode 106 is reduced to form hydrogen peroxide when it contacts the electrolyte therein. The hydrogen peroxide rich electrolyte trickles down inside the channels of cathode 106 and is collected at electrolyte outlet port 108.

For the purpose of this invention, the channels and pores are distinguished in that in a channel the effect of gravity is greater on the electrolyte than the effect of capillary forces and in a pore the effect of gravity is less on the electrolyte than the effect of capillary forces.

In the cell, liquid flow through the separating means 112 should be controlled at a level sufficient to fill only a portion of the pores in the cathode 106. If too much liquid passes through the separator and substantially all of the pores of the cathode 106 are filled, oxygen gas is displaced. This can result in the formation of explosive hydrogen gas. Conversely, if too little electrolyte passes through the separating means 112, the electrochemical reactions will be minimized. The present invention prevents the almost total filling of the cathode pores while at the same time preventing the almost total absence of electrolyte from the cathode.

Figure 2:
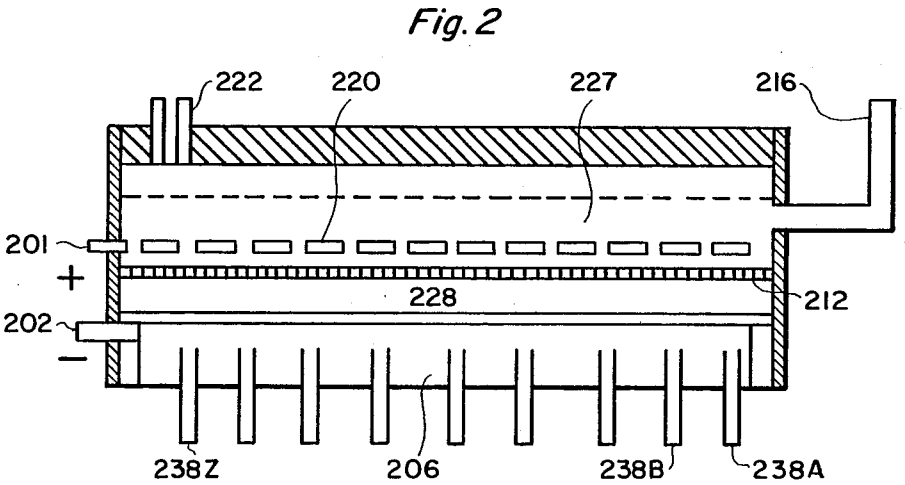
FIG. 2 is a cross sectional view of a cell in which the cathode, separating means and anode are disposed in a generally horizontal position with the anode superior.

FIG. 2 is similar to FIG. 1 except for the generally horizontal rather than vertical orientation of the cell. Each of the elements comprising the cell is enumerated similarly to the corresponding element of FIG. 1 except in the "200's", rather than "100's". One exception is that the outlet port 108 is replaced by a plurality of small diameter outlet ports represented by 238A, 238B to 238Z, which function as channels. Gravity acting on the electrolyte in the outlet ports provides a slight suction within cathode 206 drawing the electrolyte into the outlet ports and thereby prevents the electrolyte from filling the pores employed by oxygen gas.

For the purposes of this invention, the term "generally horizontal" can include angles of up to about 45°. It is clear that the outlet ports 238A, 238B to 238Z need not be perpendicular to cathode 206. For example, the outlet ports can be inclined at an angle to be essentially vertical even if cathode 206 is inclined from the absolute horizontal.

Figure 3:
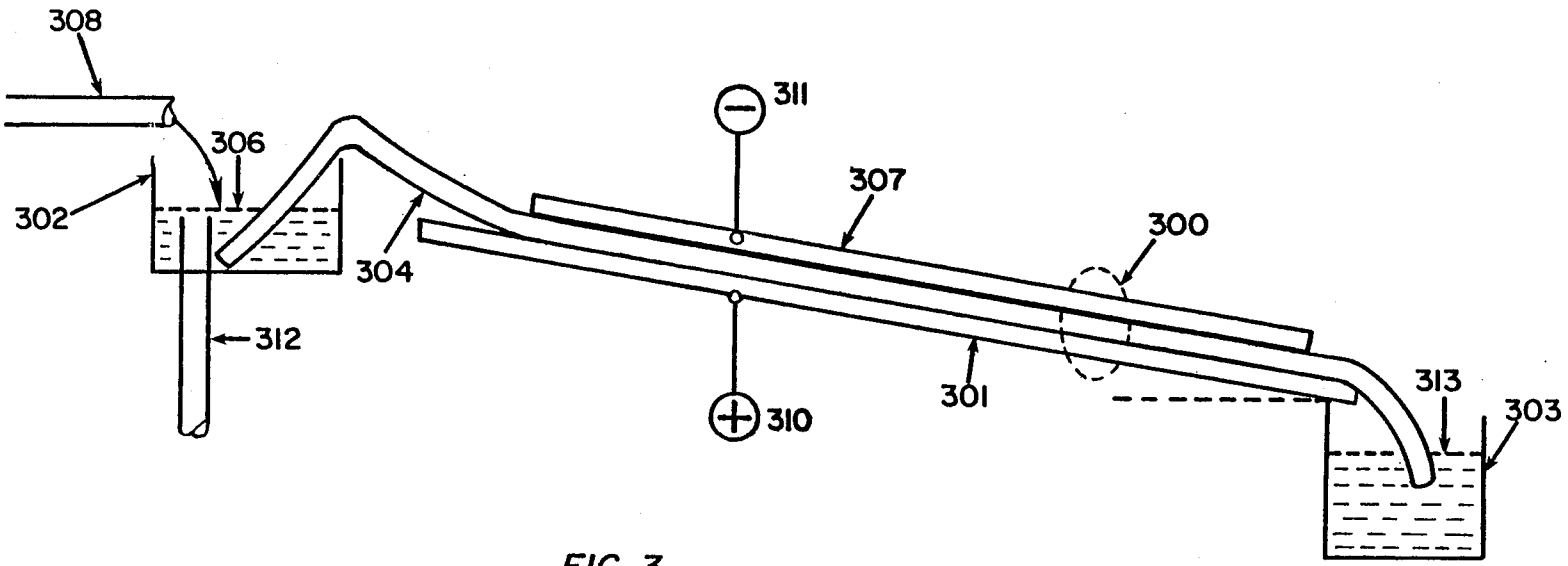
FIG. 3 is a cross sectional view of a cell in which the cathode, separating means and anode are disposed in a generally horizontal position with the cathode superior.

A view of another embodiment of the invention, cell 300 is shown in FIG. 3.

FIG. 3. Anode 301, a nickel or stainless steel plate, is disposed in a generally horizontal attitude between electrolyte reservoir 302 and electrolyte surge tank 303.

A sheet of a polyester felt fabric 304 is supported on anode 301 with a first end in reservoir 302 forming an electrolyte inlet and the second end in surge tank 303 to form an electrolyte outlet. Electrolyte is urged through the cell by the wicking action of polyester felt 304 and by the static head between the level of electrolyte in reservoir 302 and the electrolyte surge tank 303. Reservoir 302 contains sufficient electrolyte 306 so that the upper surface of electrolyte 306 is higher than the second end of polyester felt 304 at electrolyte surge tank 303. An electroconductive cathode 307 composed of carbon black bonded to graphite chips is disposed to provide a first surface contacting and above polyester felt 304. The second surface of the cathode forms an exterior surface of cell 300. Cell 300 consists of anode 301, the portion of polyester felt 304 adjacent to the anode, and cathode 307. The polyester felt 304 defining the space between the anode 301 and cathode 307 into an anode compartment (not shown) and a cathode compartment (not shown but including part of cathode 307). Conduit means 308 provides electrolyte to electrolyte reservoir 302 from a source (not shown). Conductors 310 and 311 provide a voltage to anode 301 and cathode 307 respectively from a source (not shown).

In operation electrolyte from reservoir 302 is drawn by the wicking effect of felt 304 into cell 300 where oxygen gas is formed. The oxygen is directed from the anode compartment by the felt 304 into the cathode compartment and to cathode 307 where it is reduced to hydrogen peroxide. Additional oxygen diffuses from the oxygen-containing gas at the electrolyte interface in the surface of cathode 307 where it is also reduced to hydrogen peroxide. The electrolyte is urged from the electrolyte inlet to the electrolyte outlet by the static head between the level of electrolyte in reservoir 302 and the electrolyte surge tank 303 in combination with the wicking effect of separating means 304.

One skilled in the art will recognize that in the present invention oxygen is always able to diffuse into cathode because the cathode comprises an exterior surface of the cell and is always in contact with the atmosphere.

The cells exemplified in FIGS. 2 and 3 have an added advantage over a substantially vertical cell in that the hydrostatic pressures are uniform over the separating means and the cathode so that the rate of diffusion of oxygen into the cathode and the rate of flow of electrolyte through the separating means and into the cathode are also uniform throughout the cell.

There are two convenient methods for controlling the flow through the separating means into the electrode. One method is by varying the area of the separating means contacted by the liquid and a second method is by adjusting the pressure drop across the separating means.

In a vertical cell a convenient way of controlling the area of the separating means exposed to the liquid is by increasing or decreasing the height of the liquid reservoir of the anode compartment adjoining the separating means. As the height is increased, the flow through the separating means increases. Conversely, as the height is decreased, the flow decreases. However, this varies the area of cathode and anode in contact with the electrolyte and hence the cell capacity.

Another method of controlling the flow through the separating means of a vertical cell is by controlling the pressure drop across the separating means. The pressure drop may be controlled in several ways.

One method of controlling the pressure drop across the separating means of the cell of FIG. 1 is by operating the anode compartment under gas or liquid pressure. In this method, the opposing compartment is sealed from the atmosphere and gas pressure or liquid pressure is exerted on the electrolyte. Pumps may be used to force a pressurized liquid into the opposing compartment or the pressure may be maintained by a valve attached to ports 122 or 222.

EXAMPLE 1

An electrolytic cell was constructed in accordance with FIG. 3. The cathodes were prepared in a manner similar to U.S. Pat. Nos. 4,457,953 and 4,481,303 and consisted of carbon black bonded to graphite chips (−10 and +20 mesh) with colloidal polytetrafluoroethylene (PTFE). The separating means was a commerical 38 cm×17 cm polyester felt 1.15 mm thick, and the anode was a 27 cm×19 cm nickel plate. A 12×12 mesh nickel screen was employed as a current collector. A 3.7% solution of sodium hydroxide containing 0.05% disodium EDTA was employed as the electrolyte. The cell was inclined at an angle of about 12° and oxygen gas contacted the second surface of the cathode. The average electrolyte flow rate was 8.3 g/min. The electrolyte contained 0.7% $H_2O_2$ and current efficiency after 5 hours was calculated to be 72.3%. The current density was 0.02 A/cm$^2$ at a voltage of 1.3 v.

I claim:

1. An electrolytic cell for reducing oxygen to hydrogen peroxide at a cathode in the presence of an aqueous alkaline electrolyte comprising a cell having an electrolyte inlet, a porous, self-draining cathode with a first surface contacting electrolyte and a second surface forming an exterior surface of the cell, an electrolyte outlet disposed to receive electrolyte draining from the cathode, an anode, separating means between the cathode and the anode defining an anode compartment containing the electrolyte inlet and a cathode compartment, the separating means being substantially permeable to the electrolyte, the second surface of the cathode contacting an oxygen-containing gas, said cell having means to controllably urge the electrolyte from the electrolyte inlet through the separating means and into the self-draining cathode at a rate about equal to the drainage rate of the electrolyte from the cathode and in a quantity sufficient to fill only a portion of the pores of the cathode and having means to divert oxygen gas away from the separating means and means to exhaust a gas in the anode compartment out of the electrolytic cell.

2. The electrolytic cell of claim 1 wherein the cathode is substantially vertical and the means to divert oxygen gas in the anode compartment electrolyte away from the separating means comprises louvres in the anode.

3. The electrolytic cell of claim 1 wherein the cathode is generally horizontal and the anode is permeable to a gas and is disposed in the cell in a position superior to the cathode and separating means, the means to divert oxygen gas away from the separating means and out of the electrolytic cell is the permeable anode.

4. An electrolytic cell for reducing oxygen to hydrogen peroxide at a cathode in the presence of an aqueous alkaline electrolyte comprising a cell having an electrolyte inlet, a generally horizontal, porous, self-draining cathode with a first surface immersed in the electrolyte and a second surface forming an exterior surface of the cell, an electrolyte outlet disposed to receive electrolyte draining from the cathode, the electrolyte inlet being above the electrolyte outlet to provide a static head, an anode contacting the electrolyte, a porous separating means contacting the first surface of the cathode and the anode, and a current collector contacting the cathode above the level of the electrolyte in the cathode, the second surface of the cathode contacting an oxygen-containing gas, the porous separating means and the static head between the electrolyte inlet and the electrolyte outlet controllably urging the electrolyte from the electrolyte inlet through the separating means and into the selfdraining cathode at a rate about equal to the drainage rate of the electrolyte from the cathode and in a quantity sufficient to fill only a portion of the pores of the cathode and the porous separating means providing means to divert oxygen gas away from the separating means and the means to exhaust oxygen gas out of the electrolytic cell is the cathode.

5. The electrolytic cell of claim 4 wherein the cathode comprises carbon black bonded to graphite chips by polytetrafluoroethylene.

6. The electrolytic cell of claim 4 wherein the cell is inclined at an angle of from about 5° to 25°.

* * * * *